US005607232A

United States Patent [19]

Dahl

[11] Patent Number: 5,607,232

[45] Date of Patent: Mar. 4, 1997

[54] ASPHALT PLANT DRUM DRIVE

[76] Inventor: Joel M. Dahl, 220 F St., West Fargo, N. Dak. 58078

[21] Appl. No.: 571,428

[22] Filed: Dec. 13, 1995

[51] Int. Cl.[6] ..... B28C 5/20

[52] U.S. Cl. ..... 366/63; 366/25

[58] Field of Search ..... 366/24, 25, 23, 366/22, 54, 61, 62, 63, 144, 147, 220; 432/104, 103, 108, 111, 117, 118; 241/183

[56] References Cited

U.S. PATENT DOCUMENTS

| | | | |
|---|---|---|---|
| 1,809,629 | 6/1931 | Koehring . | |
| 2,753,163 | 7/1956 | Hilkemeier | 259/175 |
| 2,838,291 | 6/1958 | Peebles | 259/177 |
| 3,910,563 | 10/1975 | Vissers | 259/3 |
| 4,069,975 | 1/1978 | Laubach | 366/220 |
| 4,273,000 | 6/1981 | Schmid | 74/206 |
| 4,765,255 | 8/1988 | Chiarua | 432/103 |
| 4,776,788 | 10/1988 | Przewalski | 432/104 |
| 4,797,002 | 1/1989 | Heap | 366/25 |
| 5,103,687 | 4/1992 | Farnham | 74/206 |

FOREIGN PATENT DOCUMENTS

| | | | |
|---|---|---|---|
| 1573606 | 8/1980 | United Kingdom | B01F 9/06 |

OTHER PUBLICATIONS

Thermo-Max advertisement from the Aug. 1995 issue of the asphalt contractor magazine.

*Primary Examiner*—Robert W. Jenkins
*Attorney, Agent, or Firm*—Curtis V. Harr

[57] ABSTRACT

The present application discloses an asphalt drum that is supplied with a forward and rearward insulator ring. This ring is typically constructed of a ceramic insulation such as (THERMO-MAX). The insulation is further encased in a steel shell to protect the ceramic ring and to allow for a durable drive surface. Through the use of the insulation ring the typical steel trunnions may be replaced with multi-ply rubber tires. As these tires wear they may be easily and quickly replaced with readily available stock. In the typical configuration the drum will ride on four tires, two on each ring. One tire on each ring being an idler wheel while the other is a drive wheel. The entire system may also be attached to a semi trailer for transport.

9 Claims, 4 Drawing Sheets

ASPHALT PLANT DRUM DRIVE

BACKGROUND OF THE INVENTION

The present invention relates to an improved drive mechanism for an asphalt plant used in the production of asphalt. More specifically, to an insulated drum and rubber tire drive system for use with a rotating drum.

Numerous systems for the production of asphalt are currently available today. Typically these systems use a large drum to dry and mix asphalt ingredients. The drum is normally slanted and heated with a propane burner. Raw materials enter on the high end of the drum and while in the drum the raw materials are dried by the propane burner and mixed by the turning motion of the drum.

Due to the heat created by the burners the shell of the drum may exceed temperatures of 300 degrees Fahrenheit. These high operating temperatures severely limit the types and life span of drive systems used. Further the high temperatures materially contribute to the wear on the drum drive system.

In the past drums have been gear driven or attached to a chain drive. Today the drums are often driven by steel trunnions. These trunnions hold the drum in place and drive the drum. In the trunnion systems the drum is supplied with a track or annular rail. The trunnions engage this track or rail and hold the drum in place while turning it.

As the drums are slanted and create a high amount of heat the wear on the trunnions and rail systems is substantial. This wear results in frequent replacement and repair of the trunnions and rail system. This type of system is not only expensive and time consuming to repair but is often made of specialty parts which may not be easily obtained in the event of a sudden breakdown.

From the foregoing discussion it can be seen that it would desirable to have a drive system made of common parts which may be obtained locally in the event of a breakdown. It is also desirable to create a drive system which may relatively inexpensive to repair and replace with a minimum amount of down time.

The present invention addresses these problems by providing a portable asphalt plant which uses a rubber tire drive system to run the drum. These tires are protected from the heat created in the drum by a ceramic ring around the outside of the drum. The tires are typically a multiple ply heavy load industrial tire which is readily available in most areas. The present invention also offers other advantages over the prior art and solves problem associated therewith.

SUMMARY OF THE INVENTION

It is the primary objective of the present invention of the present invention to provide a method of constructing an asphalt drum drive system that utilizes multiple ply rubber tires and method of protecting the rubber tires from the extreme operating temperatures of the drum.

This objective is accomplished through an improvement in the design and construction of the drum and drive system. Prior to the present invention steel trunnion where used to drive asphalt drums as stated these trunnions were expensive to replace and wear quickly.

The present invention consists of an asphalt drum that may be supplied with a forward and rearward insulator ring. This ring is typically constructed of a ceramic insulation such as (THERMO-MAX). The insulation is then encased in a steel shell to protect the ceramic ring and to further allow for a durable drive surface.

Through the use of the insulation ring the typical steel trunnions may be replaced with multiple ply rubber tires. As these tires wear they may be easily and quickly be replaced with readily available stock.

In the typical configuration the drum will ride on four tires, two on each ring. One tire on each ring being an idler wheel while the other is a drive wheel.

As the drum is slanted and tends to run down hill the tires may be adjusted to run at a slight angle so as to push the drum uphill and to hold it in an operating position.

For a better understanding of the improvements provided by the present invention, reference should be made to the drawings in which there is illustrated and described preferred embodiments of the present invention.

DESCRIPTION OF THE PREFERRED EMBODIMENT

Figure 1:
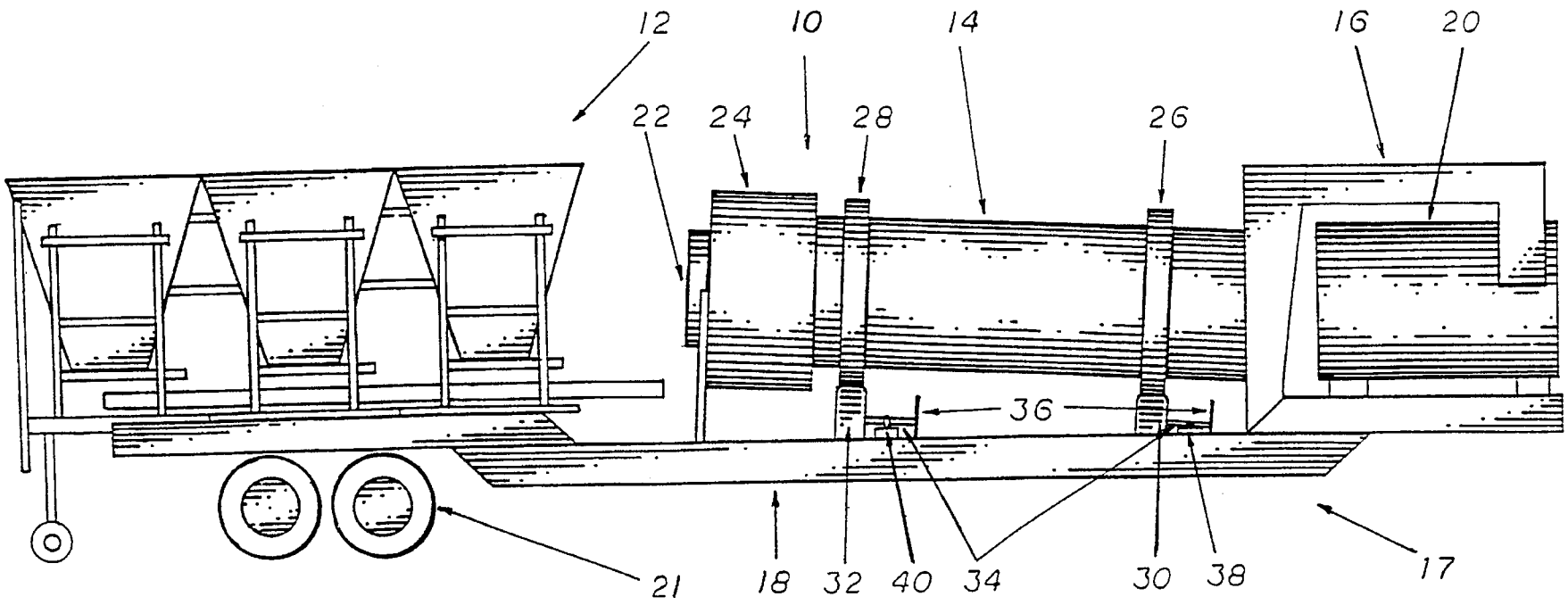
FIG. 1 is a side elevation view of the rubber tire driven asphalt drum showing is configuration in relation to material bins when installed on a single semi trailer portable asphalt plant.
Figure 2:
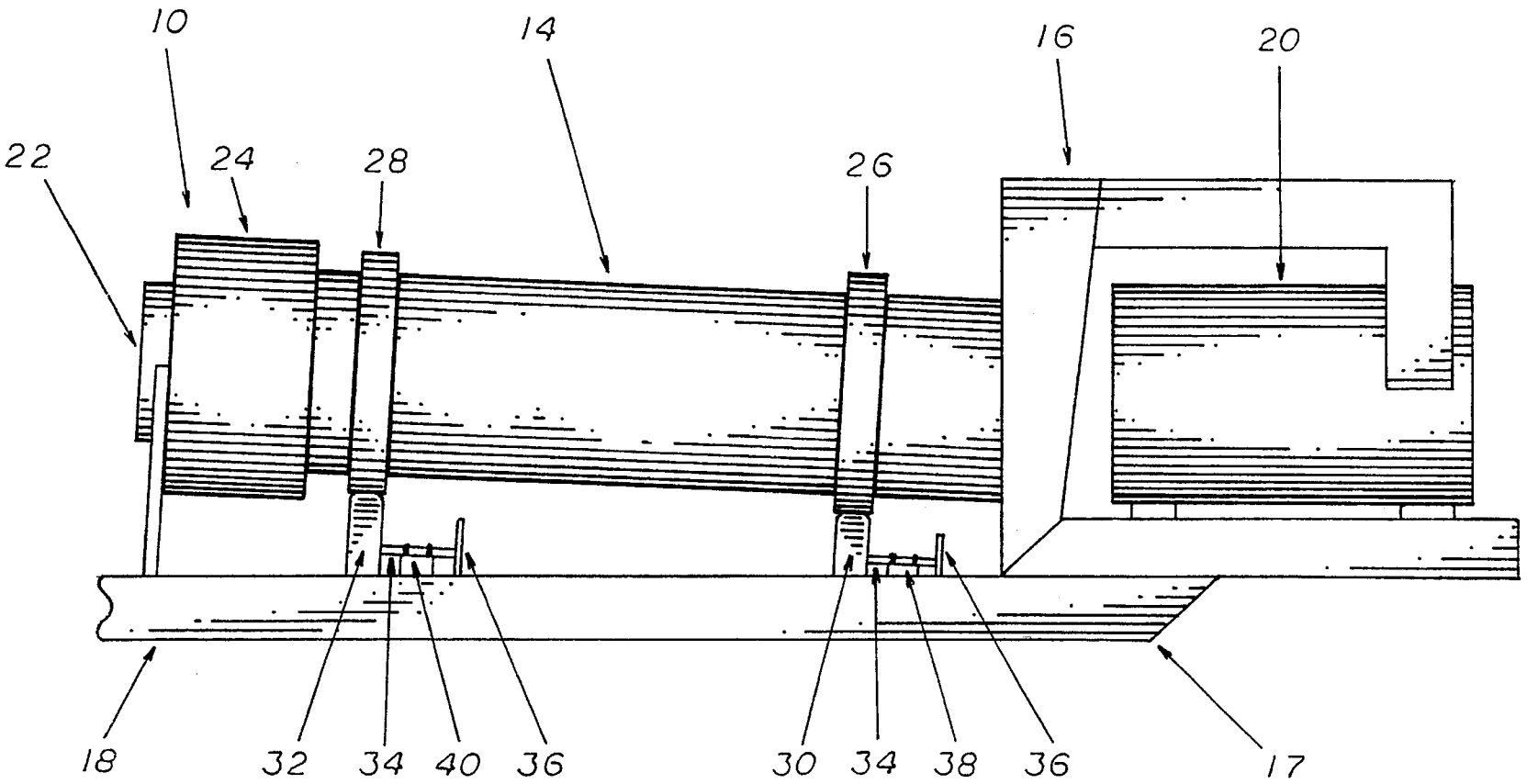
FIG. 2 is a is a side elevation view of the present invention showing the orientation of its major components and their relationship to one another when they are mounted on a semi trailer.

Referring now to the drawings, and more specifically to FIGS. 1 and 2, the rubber tire driven asphalt drum 10 is mounted on the frame 18 of a semi trailer 17. When using a single trailer portable asphalt plant, the present invention is mounted to said frame 18 in a forward position to that of the material bins 12, which are in turn mounted over the rear trailer tires 21. Forward of the rubber tire driven asphalt drum 10 and also mounted to the frame 18, is the dust separator 16 and the separator chamber 20, the purpose of which is to remove accumulated air suspended particle dust from the interior of said invention.

The present invention comprises a asphalt drum outer shell 14, which makes up most of the body, and has at the most rearward end the drum opening 22, where raw materials are introduced at the beginning of the asphalt manufacturing process. The most forward portion of the asphalt drum outer shell 14 is connected to the dust separator 16. Also mounted to the outer shell 14 is the rear collar 24 and the front insulator ring 26 and the rear insulator ring 28.

The front and rear insulator rings, 26 and 28, are engaged with the front drive tire 30 and the rear drive tire 32, which are in turn connected to the upper drive axles 34, which are then connected to the upper drive sprocket 36. These two entire assemblies are mounted on to the front cross member 38 and the rear cross member 40, the cross members 40 are finally mounted to the semi trailer frame 18. This configuration not only provides the drive inputs necessary to rotate the rubber tire driven asphalt drum 10, but also provides much of the support necessary for the operation of the said invention.

Figure 4:
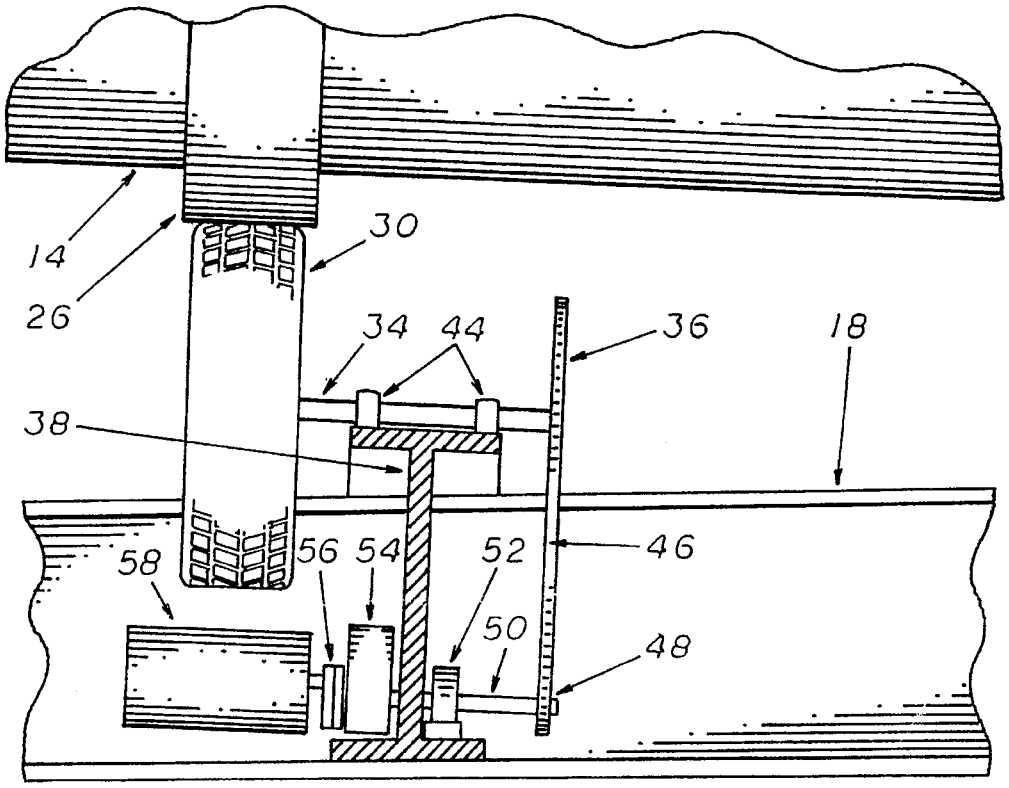
FIG. 4 is a side elevation cut-away view of the present invention showing the orientation and construction of the major drive components of said invention.
Figure 5:
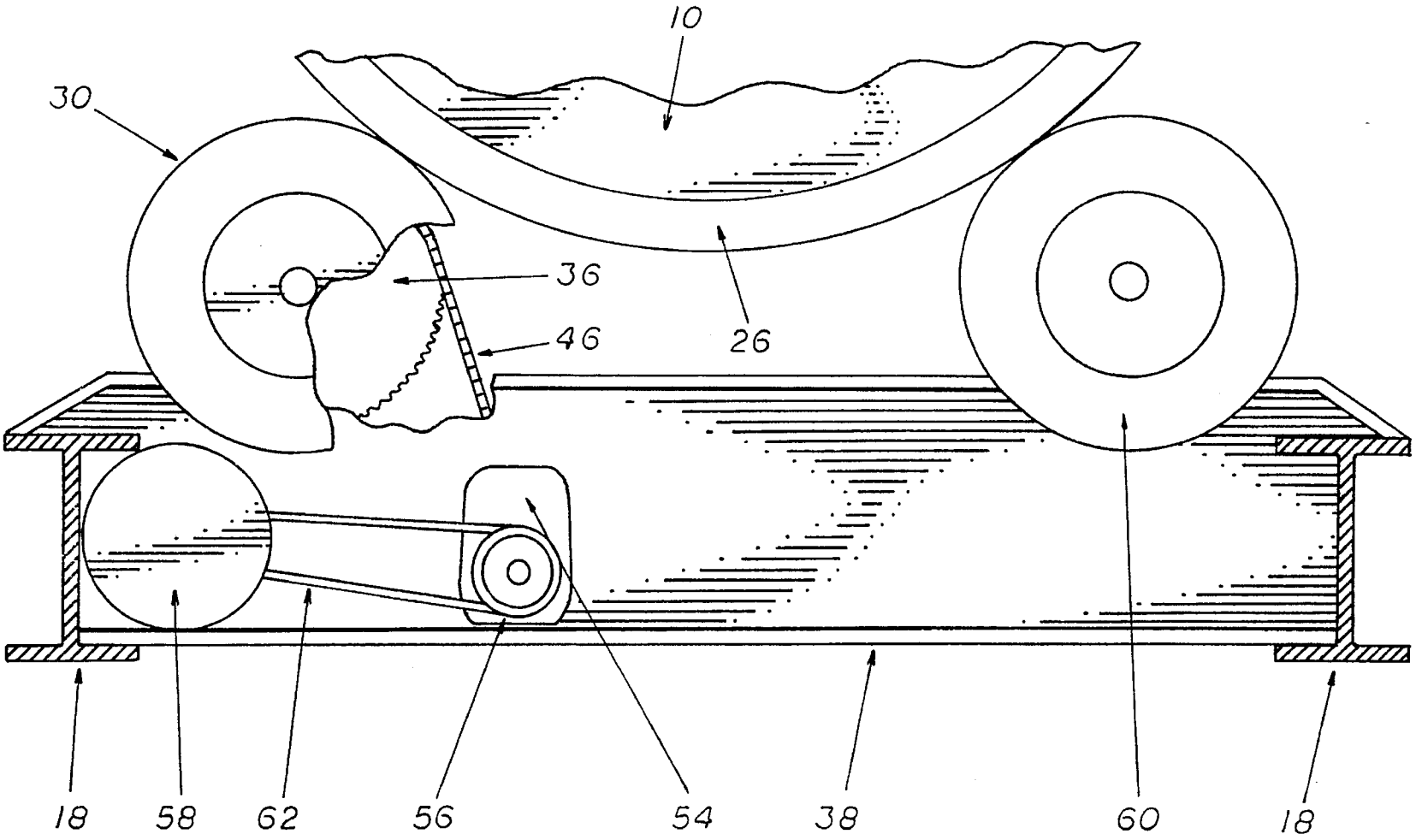
FIG. 5 is a front elevation cut-away view of the present invention again showing the orientation and construction of the major drive components of said invention and showing the manner in which the drive and idler tires relate to the asphalt tumbler cylinder.

The workings of this drive and support system are further illustrated by FIGS. 4 and 5 (the following description of the drive apparatus for the front drive tire 30 and idler tire 60 is substantially identical to that of the rear drive tire 32 and its respective idler tire 60). The rotational drive for the system is provided by the electric drive motor 58 which is mounted to the interior wall of the trailer frame 18, just rearward of the front cross member 38. The electric drive motor 58 is connected to the gear reduction box 54 by means of the dual V-belts 62 and the V-belt pulley 56 located on the gear reduction box 54.

The gear reduction box 54 is mounted to the rearward interior wall of the front cross member 38 and is connected to the lower drive sprocket 48 by means of the lower drive axle 50. The lower drive axle 50 is secured in its horizontal plane by means of the lower drive axle retainer 52, which is mounted on the forward interior wall of the front cross member 38.

The rotation of the lower drive axle 50, provided by the electric drive motor 58, generates the rotational inputs for the lower drive sprocket 48, which in turn powers the drive chain 46. The drive chain 46 encircles the upper drive sprocket 36 and the rotation therein provided rotates the upper drive axle 34. The upper drive axle 34, which is mounted to and held in its horizontal plane by means of the upper axle retainer 44 which are in turn mounted to the uppermost surface of the front cross member 38, rotates the front drive tire 30. The rotation of the front drive tire 30, which is frictionally in contact with the front insulator ring 26, provides the rotational force necessary to drive the asphalt tumbler outer shell 14, and therein the rubber tire driven asphalt tumbler 10. The idler tire 60, located on the opposite side of the front insulator ring 26 from the front drive tire 30, provides both rotational stability and support to the present invention.

Figure 3:
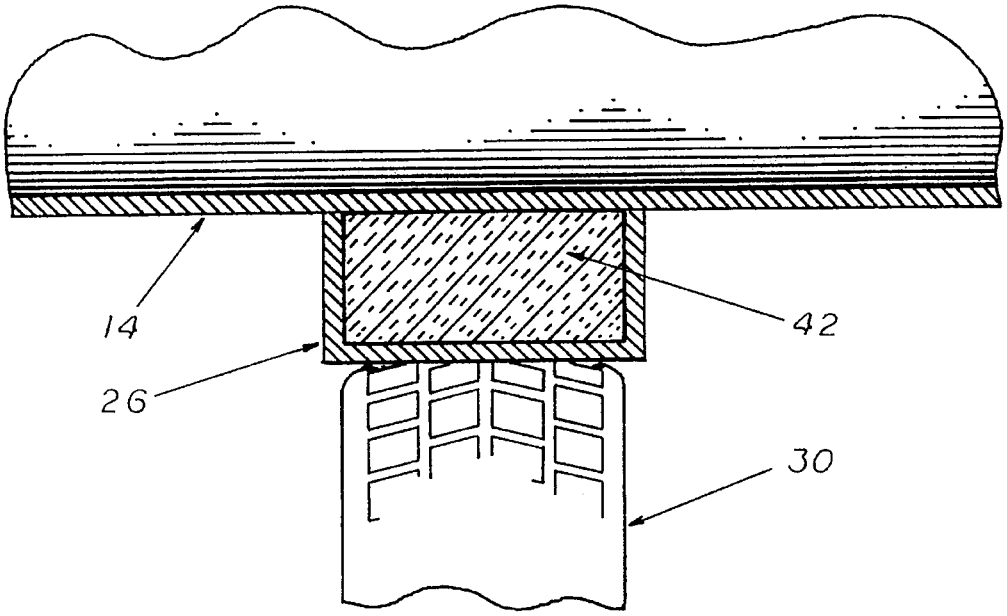
FIG. 3 is a top elevation cut-away view of the present invention showing the orientation and construction of the insulator ring in relation to the drum cylinder, emphasizing the placement of the ceramic insulator material within, and the manner in which the drive or idler tire interact with said insulator ring.

FIG. 3 illustrates the construction of the front insulator ring 26, as well as the rear insulator ring 28. The front insulator ring 26 is permanently attached to the asphalt tumbler outer shell 14 and comprises a hollow shell in which the Thermo-Max® ceramic insulator ring 42 is located. The necessity of said insulator ring 42 stems from the fact that the temperature of the asphalt contained within the asphalt tumbler outer shell 14 may exceed 600 degrees Fahrenheit. The resulting temperature on the outer surface of the asphalt tumbler outer shell 14 may exceed 300 degrees Fahrenheit. Without the use of the front insulator ring 26, this outside temperature would prohibit utilization of the rubber tire drive because it would quickly wear the front drive tire 30. The use of the ceramic insulator ring 42 allows the most outward surface of the front insulator ring 26 to run at ambient temperature, therefor allowing the use of the rubber tire driven system without substantial heat induced wear.

Although the present invention has been described in considerable detail with reference to certain preferred versions thereof, other versions are possible. Therefore, the spirit and scope of the appended claims should not be limited to the description of the preferred versions contained herein.

What is claimed is:

1. An asphalt plant drum and drive system comprising:

A cylindrical mixing drum;

One or more heat insulating rings about the outside of said drum;

A steel shell covering each of said insulating rings;

A plurality of multi-ply rubber wheels to support said drum; and

A means of driving at least one of said rubber wheels.

2. An asphalt plant drum and drive system as in claim 1 wherein said insulating ring is ceramic.

3. An asphalt plant drum and drive system as in claim 2 wherein said drum rests on four multi-ply rubber wheels, two of said four rubber wheels being driven by said drive means and two of said four rubber wheels being idler wheels.

4. An asphalt plant and drum drive system as in claim 3 wherein said means of driving said rubber wheels is one or more electric drive motors.

5. An asphalt plant and drum drive system as in claim 4 wherein the entire system is contained on a single portable trailer frame.

6. An asphalt plant drum and drive system comprising:

A semi trailer;

A cylindrical mixing drum mounted horizontally at a slight incline on said trailer;

One or more heat insulating rings about the outside of said drum;

A steel shell covering each of said insulating rings;

A plurality of multi-ply rubber wheels to support said drum; and

A means of driving at least one of said rubber wheels.

7. An asphalt plant drum and drive system as in claim 6 wherein said insulating ring is ceramic.

8. An asphalt plant drum and drive system as in claim 7 wherein said drum rests on four multi-ply rubber wheels, two of said four rubber wheels being driven by said drive means and two of said four rubber wheels being idler wheels.

9. An asphalt plant and drum drive system as in claim 8 wherein said means of driving said rubber wheels is one or more electric drive motors.

* * * * *